US010995765B2

(12) United States Patent
Sato et al.

(10) Patent No.: US 10,995,765 B2
(45) Date of Patent: May 4, 2021

(54) MAGNETIC LEVITATED PUMP

(71) Applicant: EBARA CORPORATION, Tokyo (JP)

(72) Inventors: Ichiju Sato, Tokyo (JP); Hiroshi Sobukawa, Tokyo (JP); Toshimitsu Barada, Tokyo (JP); Tomonori Ohashi, Tokyo (JP); Satoshi Mori, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 555 days.

(21) Appl. No.: 14/928,846

(22) Filed: Oct. 30, 2015

(65) Prior Publication Data

US 2016/0131141 A1 May 12, 2016

(30) Foreign Application Priority Data

Nov. 6, 2014 (JP) ..... JP2014-226210

(51) Int. Cl.
*F04D 29/22* (2006.01)
*F04D 13/06* (2006.01)
*F04D 29/048* (2006.01)

(52) U.S. Cl.
CPC ..... *F04D 29/22* (2013.01); *F04D 13/0666* (2013.01); *F04D 29/048* (2013.01)

(58) Field of Classification Search
CPC .... F04D 13/066; F04D 29/22; F04D 13/0666; F04D 29/048
USPC ..... 417/355, 356; 29/48, 22
See application file for complete search history.

(56) References Cited

U.S. PATENT DOCUMENTS 4,072,370 A * 2/1978 Wasson ..... F16C 32/0425 310/90.5
5,332,374 A 7/1994 Kricker et al.
6,234,772 B1 * 5/2001 Wampler ..... F04D 29/047 417/423.12
6,302,661 B1 * 10/2001 Khanwilkar ..... F04D 13/0646 415/900
8,226,373 B2 * 7/2012 Yaegashi ..... F04D 29/047 415/900

(Continued)

FOREIGN PATENT DOCUMENTS

EP 2 292 282 A1 3/2011
JP 3-88996 A 4/1991

(Continued)

OTHER PUBLICATIONS

Translation of JPH08144987, Jun. 1996, Kanemitsu Yoichi.*

(Continued)

*Primary Examiner* — Devon C Kramer
*Assistant Examiner* — David N Brandt
(74) *Attorney, Agent, or Firm* — Rothwell, Figg, Ernst & Manbeck, P.C.

(57) ABSTRACT

A magnetic levitated pump that does not cause pulsation of a pumped liquid and can suppress the generation of particles, which are liable to be produced by contact of a sliding part, is disclosed. The magnetic levitated pump for magnetically levitating an impeller housed in a pump casing includes a motor configured to rotate the impeller, and an electromagnet configured to magnetically support the impeller. The motor and the electromagnet are arranged so as to face each other across the impeller, and the motor is arranged on the opposite side of a suction port of the pump casing.

15 Claims, 7 Drawing Sheets

(56) References Cited

U.S. PATENT DOCUMENTS

2012/0035411 A1* 2/2012 LaRose ..... F04D 13/0666
600/16

FOREIGN PATENT DOCUMENTS

| | | | | | |
|---|---|---|---|---|---|
| JP | 7-504015 | A | | 4/1995 | |
| JP | H08144987 | | * | 6/1996 | ..... F04D 13/02 |
| JP | 2000-509311 | A | | 7/2000 | |
| JP | 2001-254693 | A | | 9/2001 | |
| JP | 2003-516212 | A | | 5/2003 | |
| JP | 2007-224895 | A | | 9/2007 | |
| JP | 2008-132131 | A | | 6/2008 | |
| JP | 2009-523488 | A | | 6/2009 | |
| JP | 2009-197736 | A | | 9/2009 | |
| JP | 2010-136863 | A | | 6/2010 | |
| WO | 98/04834 | A1 | | 2/1998 | |
| WO | 99/53974 | A1 | | 10/1999 | |
| WO | 00/64508 | A1 | | 11/2000 | |

OTHER PUBLICATIONS

European Search Report dated Mar. 29, 2016 in corresponding European Patent Application No. 15192701.9 (7 pages).
Notification of Reasons for Refusal dated Jun. 26, 2018 in corresponding Japanese Patent Application No. 2014-226210 (with an English translation) (6 pages).
Notification of Reasons for Refusal dated Jan. 22, 2019 in corresponding Japanese Patent Application No. 2014-226210 (4 pages).

* cited by examiner

MAGNETIC LEVITATED PUMP

CROSS REFERENCE TO RELATED APPLICATION

This document claims priority to Japanese Patent Application Number 2014-226210 filed Nov. 6, 2014, the entire contents of which are hereby incorporated by reference.

BACKGROUND

Conventionally, as a pump for transferring pure water or a chemical liquid, there has been commonly known a positive displacement pump that compresses a liquid to a predetermined pressure by using a reciprocating diaphragm or the like to deliver the liquid intermittently. It has also been practiced to transfer pure water or a chemical liquid by using a centrifugal pump having an impeller supported by a main shaft, which is rotatably supported by a bearing, in a pump casing.

However, when the positive displacement pump is used, there arises a problem of generation of pulsation because the transfer of liquid does not become continuously smooth. On the other hand, when the centrifugal pump is used, the contact of a sliding part such as a shaft seal part or a bearing cannot be avoided, and thus particles are inevitably generated by this contact. Therefore, there is a problem of causing the particles to be mixed into the pumped liquid such as pure water or a chemical liquid and thus causing contamination of the pumped liquid.

SUMMARY OF THE INVENTION

According to an embodiment, there is provided a magnetic levitated pump that does not cause pulsation of a pumped liquid and can suppress the generation of particles, which are liable to be produced by contact of a sliding part.

Embodiments, which will be described below, relate to a magnetic levitated pump, and more particularly to a magnetic levitated pump having a structure which can suppress the generation of particles, which are liable to be produced by contact of a rotating portion, by rotating an impeller in a non-contact manner, and thus can prevent a pumped liquid such as pure water or a chemical liquid from being contaminated by the particles.

In an embodiment, there is provided a magnetic levitated pump with an impeller housed in a pump casing and to be magnetically levitated, the magnetic levitated pump comprising: a motor configured to rotate the impeller; an electromagnet configured to magnetically support the impeller; wherein the motor and the electromagnet are arranged so as to face each other across the impeller; and the motor is arranged on the opposite side of a suction port of the pump casing.

According to the embodiment, an axial thrust is applied by a pressure difference between a pressure in the pump casing and a pressure in the suction port during operation of the pump, and thus the impeller is pushed to the suction port side. However, the motor arranged on the opposite side of the suction port can apply an attractive force that pulls back the impeller to the opposite side of the suction port side, and thus the axial thrust generated by the differential pressure of the pump can be cancelled out. Therefore, control of the impeller in the thrust direction by the electromagnet during operation of the pump can be zero-power (no-electric power) control.

In an embodiment, the motor is a permanent magnet motor having a permanent magnet on the impeller side.

According to the embodiment, since the motor is a permanent magnet motor having a permanent magnet on the impeller side, an attractive force always acts on the impeller from the motor, so that the force that pulls back the impeller, which is pushed to the suction port side by the axial thrust, toward the opposite side can be exerted.

In an embodiment, a ring-shaped permanent magnet is provided at an axial end portion of the impeller and a ring-shaped permanent magnet is provided at a position, of the pump casing, which radially faces the axial end portion of the impeller to allow the permanent magnet at the impeller side and the permanent magnet at the pump casing side to face each other in a radial direction, thereby constructing a permanent magnetic radial repulsive bearing. Here, the axial direction of the impeller refers to a direction of an axis of the rotating shaft of the impeller, i.e., a thrust direction.

According to the embodiment, if radial rigidity obtained only by a passive stabilizing force is insufficient, the radial rigidity can be supplemented by the permanent magnetic radial repulsive bearing. Thus, the axial end portion of the impeller can be stably supported in a non-contact manner by the magnetic repulsive force.

In an embodiment, the permanent magnet on the impeller side and the permanent magnet on the pump casing side are positionally shifted in the axial direction.

According to the embodiment, because the permanent magnet on the impeller side and the permanent magnet on the pump casing side are positionally shifted in the axial direction, a force in a direction opposite to the attractive force which allows the motor to attract the impeller, i.e., a force for pushing the impeller to the suction port side, can be generated. Since the attractive force which allows the motor to attract the impeller can be reduced by the force for pushing the impeller to the suction port side, an electromagnetic force of the electromagnet can be reduced when performing the control of disengaging the impeller, which is attracted to the motor side at the time of pump startup, from the motor by the electromagnetic force of the electromagnet. Thus, the electric power of the electromagnet at the time of pump startup can be reduced.

In an embodiment, a sliding bearing is provided between an axial end portion of the impeller and a portion, of the pump casing, which radially faces the axial end portion of the impeller.

According to the embodiment, if the radial rigidity obtained only by the passive stabilizing force is insufficient, the radial rigidity can be supplemented by the sliding bearing. Thus, the axial end portion of the impeller can be supported in a stable manner.

In an embodiment, the axial end portion of the impeller constitutes a suction port of the impeller or a portion projecting from a rear surface of the impeller.

In an embodiment, the displacement of the impeller is detected based on impedance of the electromagnet.

According to the embodiment, a sensor for detecting a position of the impeller as a rotor is not required, and thus the control of the electromagnet can be performed without a sensor.

In an embodiment, a liquid contact portion that is brought into contact with a liquid to be pumped in the pump casing comprises a resin material.

According to the embodiment, the liquid contact portion, such as an inner surface of the pump casing or the impeller, that is brought into contact with the liquid to be pumped is coated with the resin material such as PTFE or PFA, or all the constituent parts of the liquid contact portion are composed of the resin material. Therefore, metal ions are not generated from the liquid contact portion.

The above-described embodiments offer the following advantages.

1) The generation of particles which are liable to be produced by contact of a rotating portion or a sliding portion can be suppressed by rotating the impeller in a non-contact manner. Thus, a problem that particles are mixed into the pumped liquid such as pure water or a chemical liquid to contaminate the pumped liquid can be solved.

2) Since the magnetic levitated pump is constructed with a centrifugal pump, the liquid such as pure water or a chemical liquid can be transferred continuously and smoothly, and pulsation of the pumped liquid is not generated.

3) An axial thrust is applied by a pressure difference between a pressure in the pump casing and a pressure in the suction port during operation of the pump to push the impeller to the suction port side. However, the motor arranged on the opposite side of the suction port can apply an attractive force that pulls back the impeller to the opposite side of the suction port side, and thus the axial thrust generated by the differential pressure of the pump can be cancelled out. Therefore, control of the impeller in a thrust direction by the electromagnet during operation of the pump can be zero-power (no-electric power) control.

4) Since the liquid contact portion that is brought into contact with the liquid to be pumped in the pump casing is composed of the resin material such as PTFE or PFA, metal ions are not generated from the liquid contact portion.

BRIEF DESCRIPTION OF THE DRAWINGS

FIG. 7A is a front elevational view of the magnetic levitated centrifugal pump and FIG. 7B is a side view of the magnetic levitated centrifugal pump.

DESCRIPTION OF EMBODIMENTS

Figure 1:
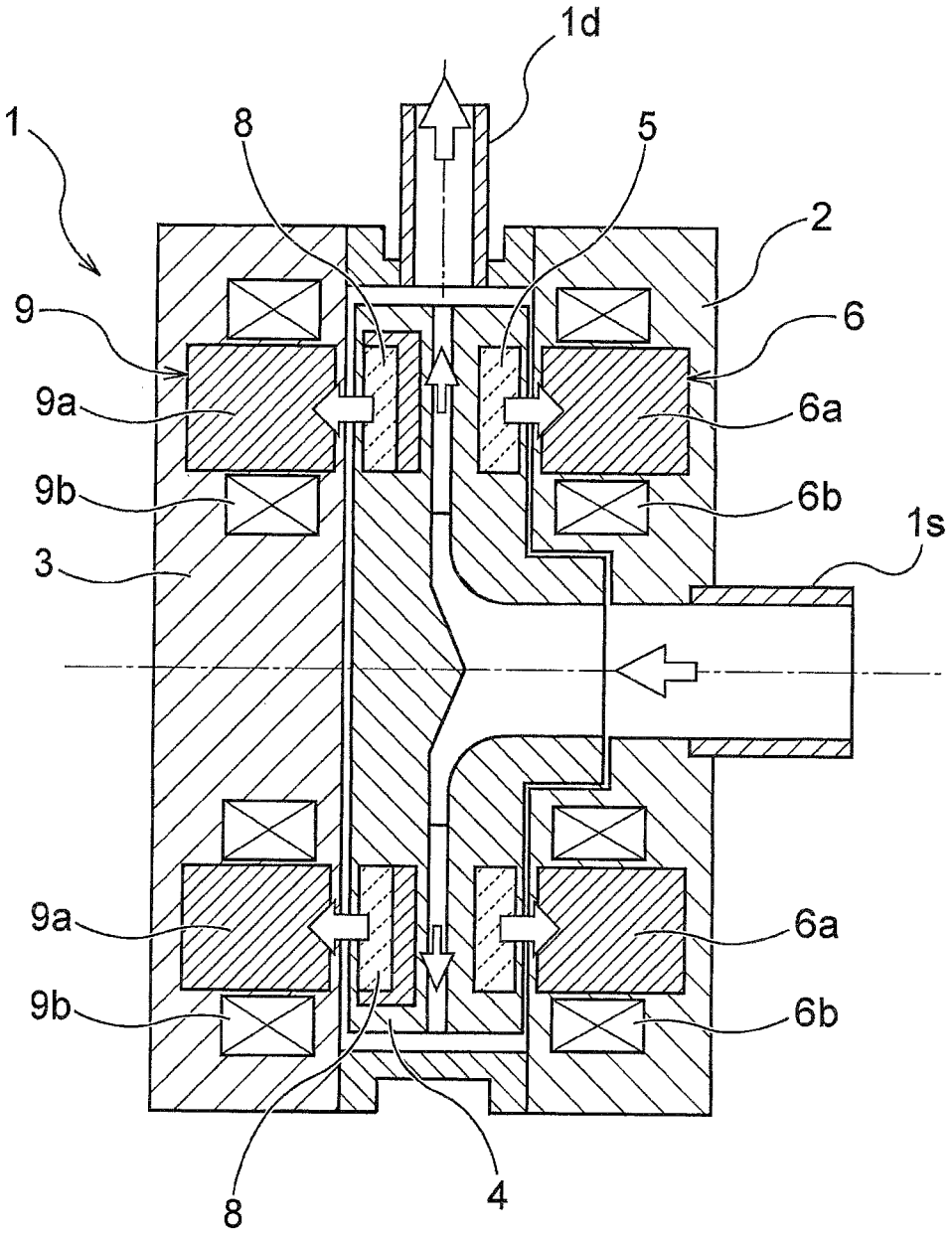
FIG. 1 is a vertical cross-sectional view showing a magnetic levitated centrifugal pump which is an embodiment of a magnetic levitated pump.

Embodiments of a magnetic levitated pump will be described below with reference to FIGS. 1 through 7A, 7B. In FIGS. 1 through 7A, 7B, identical or corresponding parts are denoted by identical or corresponding reference numerals throughout views, and will not be described in duplication.

FIG. 1 is a vertical cross-sectional view showing a magnetic levitated centrifugal pump which is an embodiment of a magnetic levitated pump. As shown in FIG. 1, the magnetic levitated centrifugal pump 1 comprises a substantially cylindrical container-shaped casing 2 having a suction port 1*s* and a discharge port 1*d*, a casing cover 3 covering a front opening of the casing 2, and an impeller 4 housed in a pump casing comprising the casing 2 and the casing cover 3. A liquid contact portion, such as an inner surface of the pump casing comprising the casing 2 and the casing cover 3, is formed in a resin canned structure made of PTFE, PFA, or the like. The inner surface of the pump casing comprises both flat end surfaces and a cylindrical inner circumferential surface, and the interior of the pump casing is designed not to have a recessed portion so that there is no air pocket.

In the casing 2, there is provided an electromagnet 6 for attracting a rotor magnetic pole 5 made of a magnetic material, such as a silicon steel sheet, embedded in a front surface of the impeller 4 to support the impeller 4 by magnetism. The electromagnet 6 has electromagnet cores 6*a* and coils 6*b*. In the casing cover 3, there is provided a motor 9 for rotating the impeller 4 while attracting permanent magnets 8 embedded in a rear surface of the impeller 4. The motor 9 has motor cores 9*a* and coils 9*b*. Because the electromagnet 6 and the motor 9 are configured to be sextupole type, respectively, the cores can be commonalized, thereby reducing the cost.

The magnetic levitated centrifugal pump 1 shown in FIG. 1 has a simple structure in which the electromagnet 6 and the motor 9 are arranged so as to face each other across the impeller 4. An axial thrust is applied to the impeller 4 by a pressure difference between a pressure in the pump casing and a pressure in the suction port during operation of the pump, and thus the impeller 4 is pushed to the suction port side. However, since the motor 9 is a permanent magnet motor having the permanent magnets 8 on the impeller side, an attractive force always acts on the impeller 4, so that the force that pulls back the impeller 4, which is pushed to the suction port side by the axial thrust, toward the opposite side can be exerted. In other words, the motor 9 is arranged on the opposite side of the suction port 1*s* so that the attractive force by the permanent magnet motor and the axial thrust by the differential pressure of the pump can be balanced.

On the other hand, the electromagnet 6 disposed on the front surface side of the impeller 4 is configured as a magnetic bearing that generates a Z-axis control force (control force in a thrust direction) which is balanced with the motor attractive force, and a control force for correcting the tilt of θx (about an X-axis) and θy (about a Y-axis) defined as the tilt (rotation) with respect to the X-axis and the Y-axis which are axes perpendicular to the Z-axis, so that the electromagnet 6 supports the impeller 4 in a non-contact manner in the pump casing. Further, the position of the impeller 4 can be detected by detecting the displacement of the impeller 4 as a rotor based on impedance of the electromagnet 6, thus allowing a sensor-less structure which requires no position sensor. Since the position where the control force acts is detected, so-called collocation conditions are met, and thus a structure that allows the electromagnet 6 to be easily controlled can be employed.

As shown in FIG. 1, the motor 9 and the electromagnet 6 are disposed so as to face the impeller 4 respectively, thus becoming a compact structure in a radial direction. In this manner, the axial-type motor is selected to make radial dimension of the pump compact, and the permanent-magnet type motor is selected to have an improved efficiency and to obtain a large torque. Thus, the impeller 4 as a rotor is reliably attracted to the motor side, and therefore the electromagnet is disposed on the opposite side to counteract such attractive force. With such arrangement, the structure that can control three degrees of freedom (Z, θx, θy) by the electromagnet disposed on one side can be realized.

Figure 2:
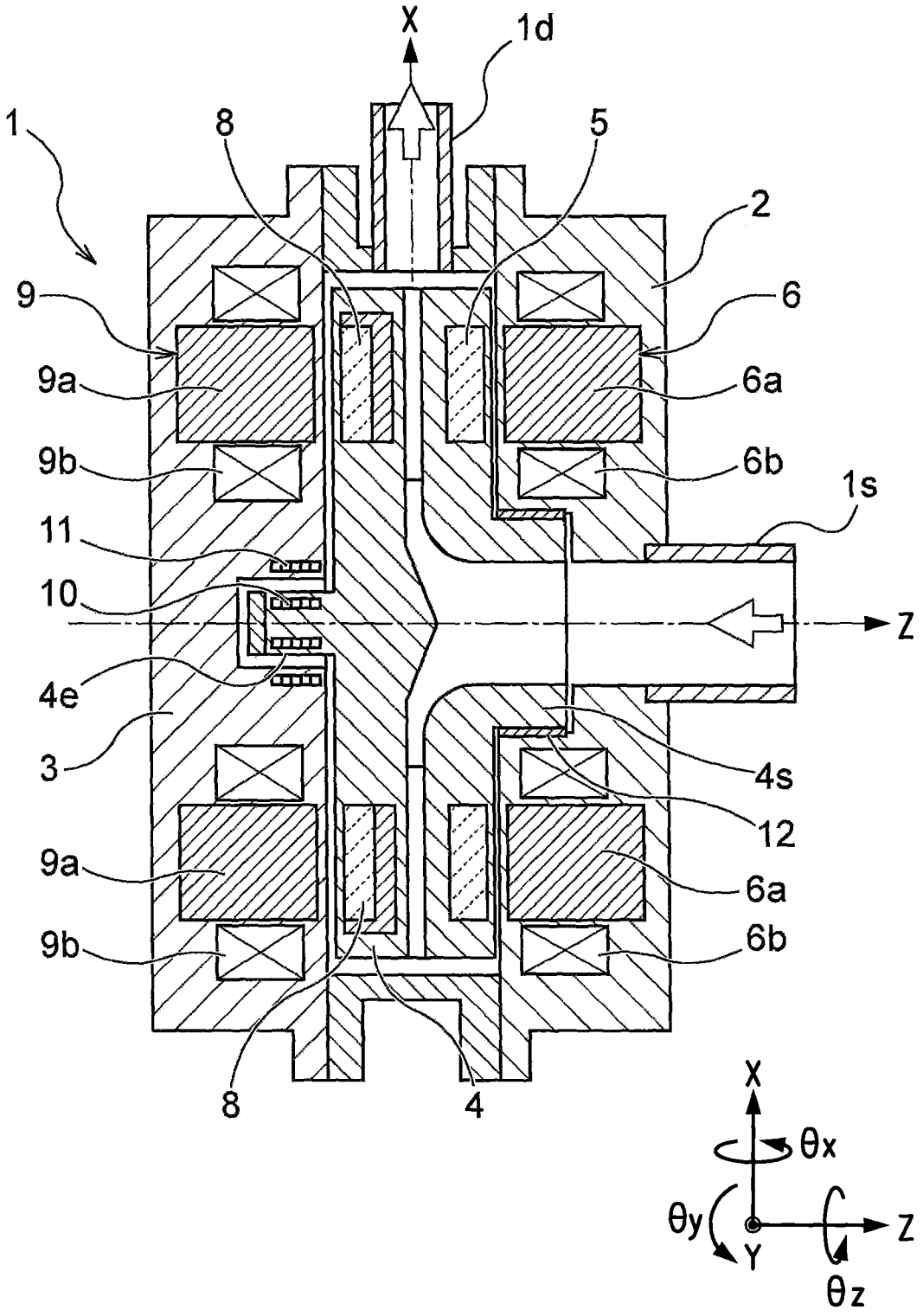
FIG. 2 is a vertical cross-sectional view showing another embodiment of the magnetic levitated pump.

FIG. 2 is a vertical cross-sectional view showing another embodiment of the magnetic levitated pump. The magnetic levitated pump shown in FIG. 2 is a magnetic levitated centrifugal pump as with FIG. 1. In the magnetic levitated centrifugal pump 1 shown in FIG. 2, a ring-shaped permanent magnet 10 is provided at an axial end portion 4*e* of the impeller 4 and a ring-shaped permanent magnet 11 is provided at a portion, of the casing cover 3, which radially faces the axial end portion 4*e* of the impeller 4 to allow the permanent magnet 10 on the impeller side and the permanent magnet 11 on the casing cover side to face each other in a radial direction, thereby constructing a permanent magnetic radial repulsive bearing.

Although radial rigidity is obtained by the passive stabilizing force generated by the attractive force of the electromagnet 6 and the motor 9 in the embodiment shown in FIG. 1, according to the embodiment shown in FIG. 2, if the radial rigidity obtained only by the passive stabilizing force is insufficient, the radial rigidity can be supplemented by the permanent magnetic radial repulsive bearing comprising the permanent magnet 10 on the impeller side and the permanent magnet 11 on the casing cover side. With this structure, the axial end portion of the impeller 4 can be stably supported in a non-contact manner by the magnetic repulsive force.

The permanent magnet 10 on the impeller side and the permanent magnet 11 on the casing cover side are positionally shifted slightly in the axial direction. Because the permanent magnet 10 on the impeller side and the permanent magnet 11 on the casing cover side are positionally shifted slightly in the axial direction, a force in a direction opposite to the attractive force which allows the motor 9 to attract the impeller 4, i.e., a force for pushing the impeller 4 to the suction port side, is generated. Since the attractive force which allows the motor 9 to attract the impeller 4 can be reduced by the force for pushing the impeller to the suction port side, an electromagnetic force of the electromagnet 6 can be reduced when performing the control of disengaging the impeller 4, which is attracted to the motor side at the time of pump startup, from the motor 9 by the electromagnetic force of the electromagnet 6. Thus, the electric power of the electromagnet 6 at the time of pump startup can be reduced.

Further, as shown in FIG. 2, a sliding bearing 12 is provided between the outer circumferential surface of the suction port 4*s* of the impeller 4 and a portion, of the casing 2, which radially faces the outer circumferential surface of the suction port 4*s* of the impeller 4. The sliding bearing 12 may be composed of ring-shaped ceramics fitted on the inner circumferential surface of the casing 2. The inner circumferential surface of the casing 2 may be composed of a resin material such as PTFE or PFA to thereby constitute the sliding bearing 12.

Although FIG. 2 shows the example in which the permanent magnetic radial repulsive bearing and the sliding bearing are provided at both axial end portions of the impeller 4, respectively, the permanent magnetic radial repulsive bearings may be provided at both the axial end portions of the impeller, respectively, or the sliding bearings may be provided at both the axial end portions of the impeller, respectively. Alternatively, the permanent magnet radial repulsive bearing or the sliding bearing may be provided at only one end portion, such as the suction port side, of the impeller. Other configurations of the magnetic levitated centrifugal pump 1 shown in FIG. 2 are the same as those of the magnetic levitated centrifugal pump 1 shown in FIG. 1.

Next, a control circuit of the magnetic levitated centrifugal pump 1 configured as shown in FIGS. 1 and 2 will be described.

Figure 3:
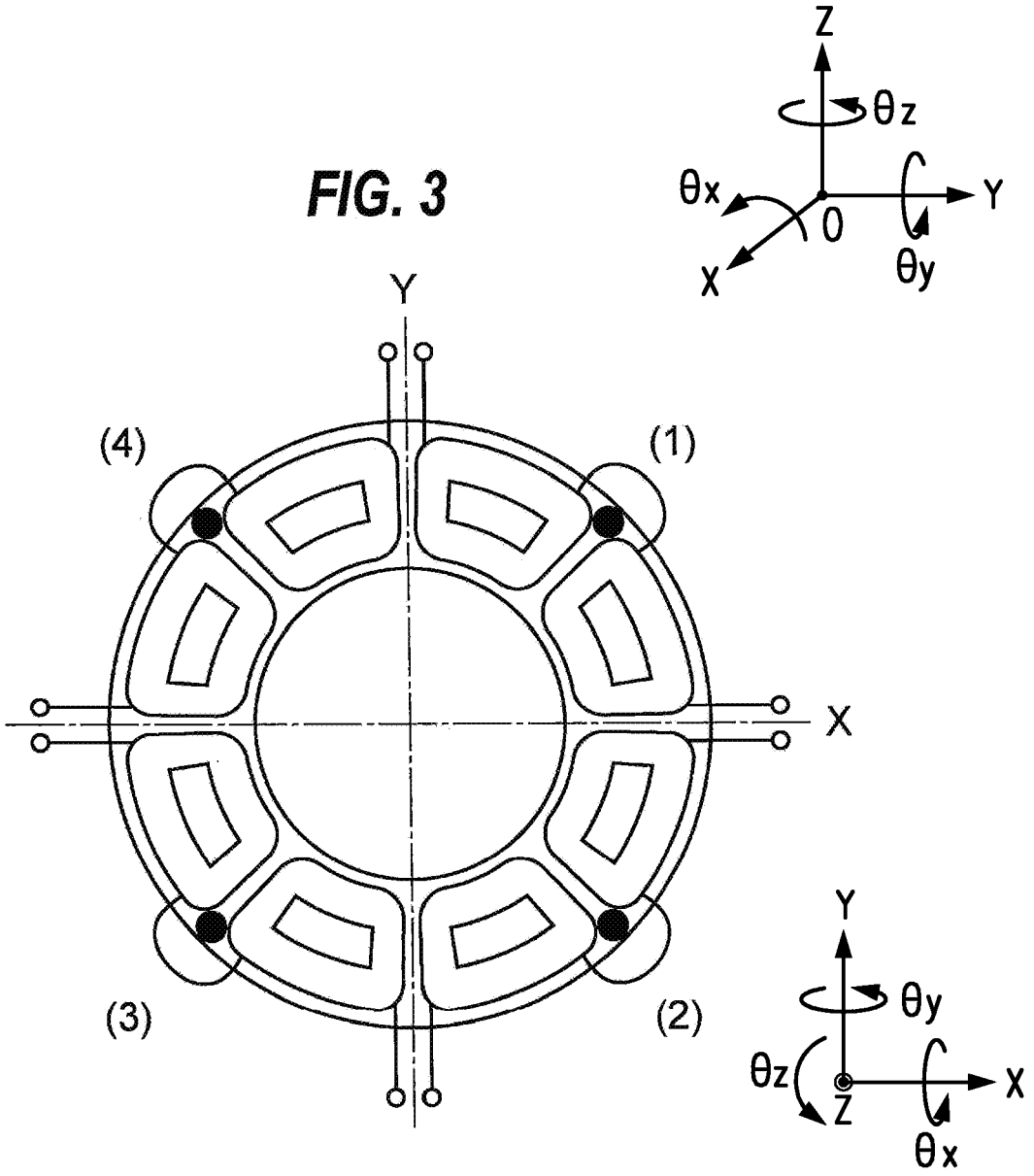
FIG. 3 is a view showing an arrangement example of control magnetic poles (eight)

As shown in FIG. 3, eight control magnetic poles are basically provided, and two adjacent poles are used as a pair. When all of (1), (2), (3) and (4) are energized, a control force in Z-direction is generated. When (1) and (2), and (3) and (4) are differentially energized, a control force for θy is generated. When (1) and (4), and (2) and (3) are differentially energized, a control force for θx is generated.

Figure 4:
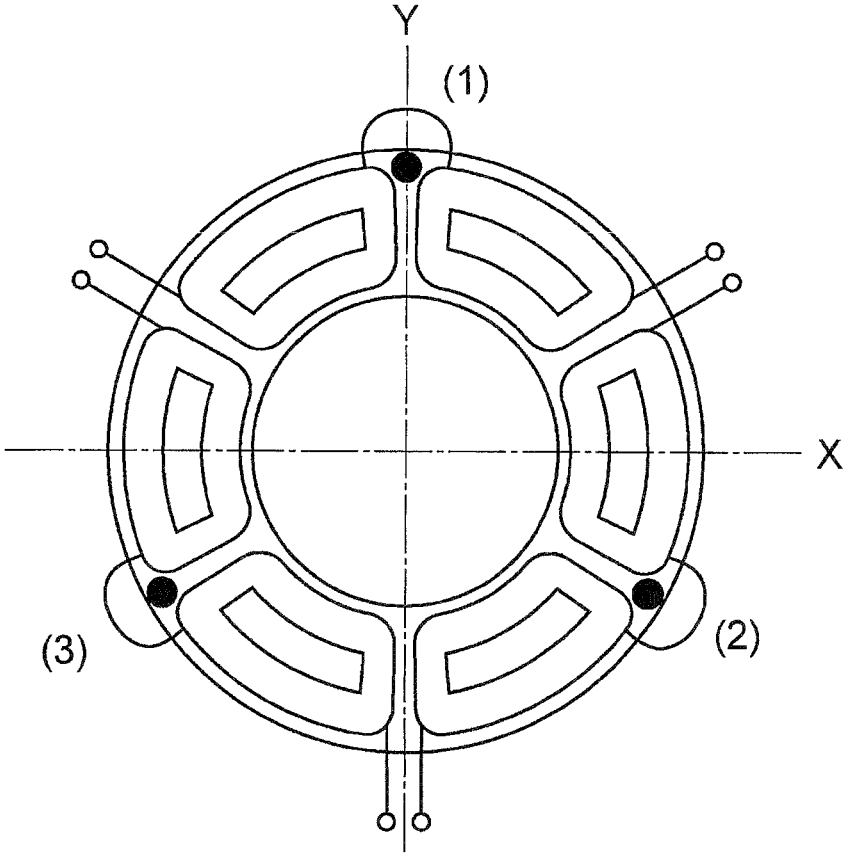
FIG. 4 is a view showing an arrangement example of control magnetic poles (six)

As shown in FIG. 4, ideally, by providing six control magnetic poles, a more compact construction can be realized. Specifically, the six control magnetic poles have advantages to lessen the number of electromagnet coils and the number of current drivers. In this case, two adjacent poles are used as a pair as well. When all of (1), (2) and (3) are energized, a control force in Z-direction is generated. When (1), and (2) and (3) are differentially energized, a control force for θx is generated. When (2) and (3) are differentially energized, a control force for θy is generated.

In order to control the three degrees of freedom (Z, θx, θy), a plurality of displacement sensors are necessary. Basically, four displacement sensors are provided, and outputs from the respective sensors are computed by a computing unit into mode outputs. Specifically, the Z-direction displacement is calculated from the sum of (1), (2), (3) and (4), θy is calculated by an equation of ((1)+(2))−((3)+(4)), and θx is calculated by an equation of ((1)+(4))−((2)+(3)).

Ideally, the number of sensors can be reduced to three, and Z, θx and θy can be determined by calculating respective outputs of the sensors.

Control laws which are optimum from respective natural frequencies are applied to the three modes of Z, θx and θy, which have been determined in the above manner, thereby calculating control outputs of the respective modes. The calculated control outputs are computed by the computing unit to allocate respective electric currents to the three or four pairs of electromagnet coils. Therefore, the movements of Z, θx and θy of the impeller 4 as a rotor is controlled, and thus the impeller 4 can be rotated stably by the motor (θz).

Further, since the differential pressure is generated during pump operation to generate a force for pushing the impeller 4 to the suction port side, if such force and the attractive force by the motor are controlled so as to be balanced, a control current can be reduced.

Specifically, with respect to the Z-direction, basically, the system is configured to allow the motor attractive force to be equal to or greater than the pump differential pressure force, i.e., the motor attractive force≥the pump differential pressure force, and the force of the electromagnet is controlled to establish the following equation, i.e., the motor attractive force=the pump differential pressure force+the electromagnetic force. Ideally, the force of the electromagnet can be 0 (zero-power control).

More ideally, if the technology of a sensor-less magnetic bearing (self-sensing magnetic bearing) for estimating a position of a gap based on impedance of the control coil is applied, the displacement sensors can be eliminated and the pump body can be further miniaturized and manufactured at a low cost.

The remaining two degrees of freedom (X, Y) out of six degrees of freedom are passively stabilized by an attractive force acting between the permanent magnet and a stator yoke of the motor and by an attractive force acting between a stator yoke of the control electromagnet and the magnetic pole of the rotor.

Since the passive stabilizing force lessens depending on the size or the gap of the motor, it is effective positively to add the radial repulsive bearing utilizing the repulsive force of the permanent magnets as described in FIG. 2. The radial repulsive bearing comprises a plurality of stacked ring-shaped permanent magnets and a plurality of permanent magnets arranged radially outwardly and having the same structure to generate a restoring force in a radial direction.

Figure 5:
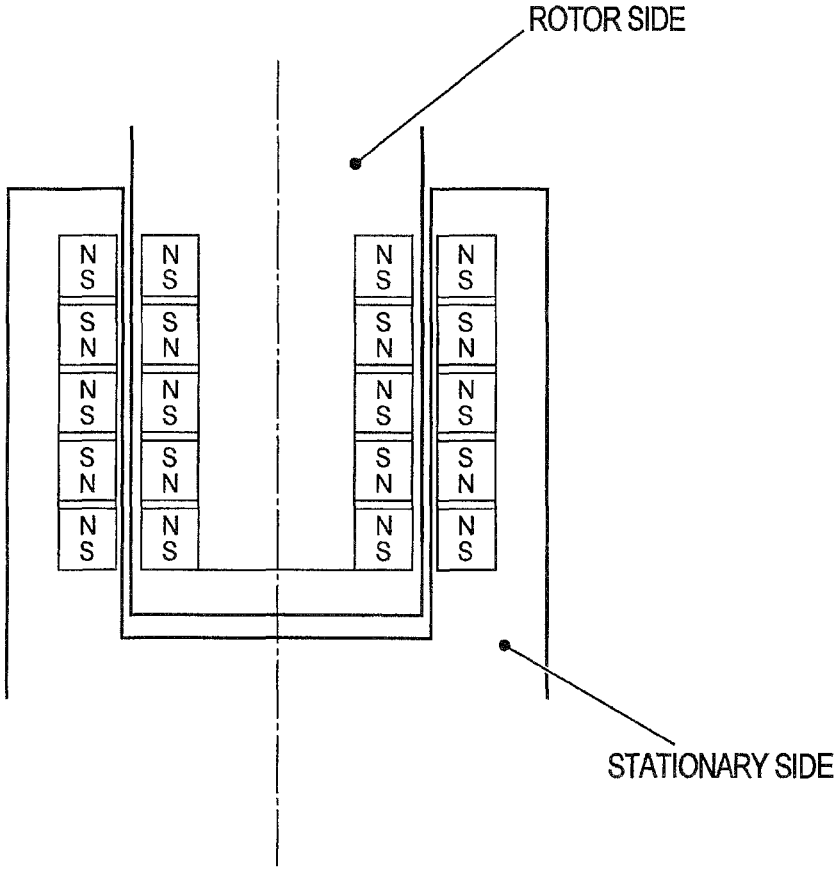
FIG. 5 is a view showing a first example of a permanent magnetic radial repulsive bearing.
Figure 6:
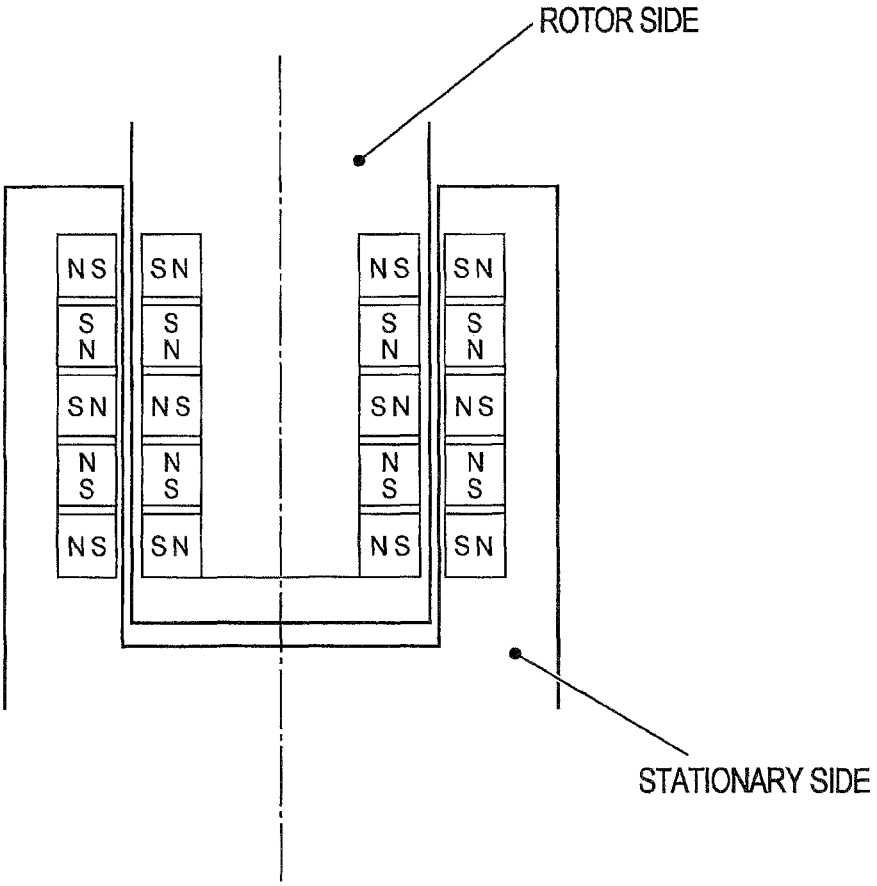
FIG. 6 is a view showing a second example of the permanent magnetic radial repulsive bearing.

Such bearing is constructed by stacking permanent magnets each of which is magnetized in the axial direction and has a magnetized direction opposite to the magnetized direction of the adjacent one as shown in FIG. 5. Ideally, as shown in FIG. 6, by combining permanent magnets which are magnetized in the axial direction and permanent magnets which are magnetized in the radial direction, greater radial rigidity can be obtained.

This type of radial bearing has unstable rigidity in the axial direction, and thus the force acts to cause one side of the radial bearing to slip out in either of both directions. Thus, the permanent magnets on the stationary side and the permanent magnets on the rotor side are positionally shifted from each other so that the force acts on the rotor (impeller 4) toward the suction port side, whereby the attractive force caused by the permanent magnets of the motor can be reduced.

Figure 7B:
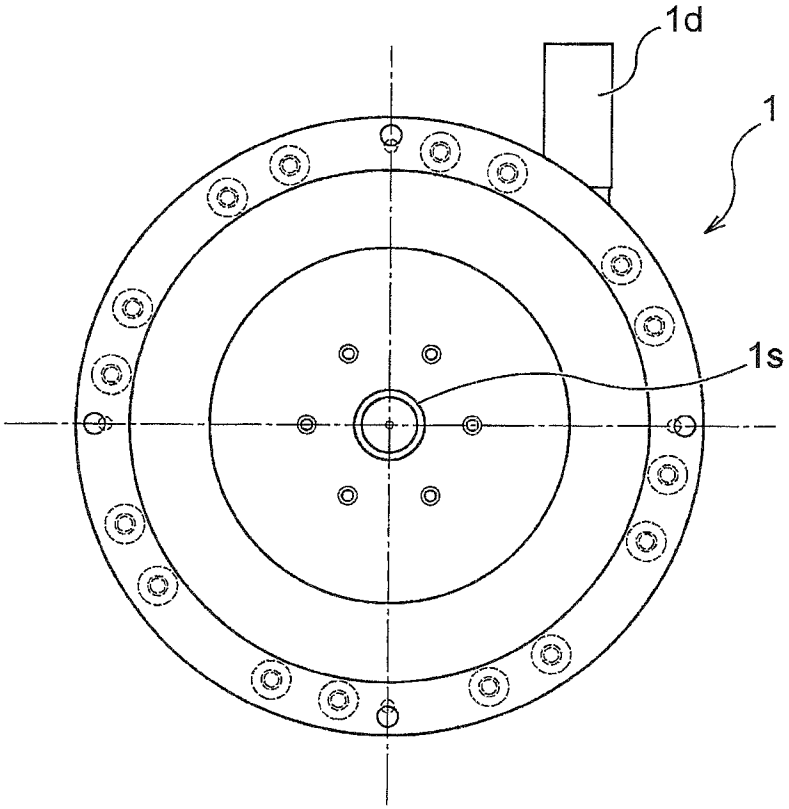
FIGS. 7A and 7B are views showing external appearance of the magnetic levitated centrifugal pump shown in FIGS. 1 and 2.
Figure 7A:
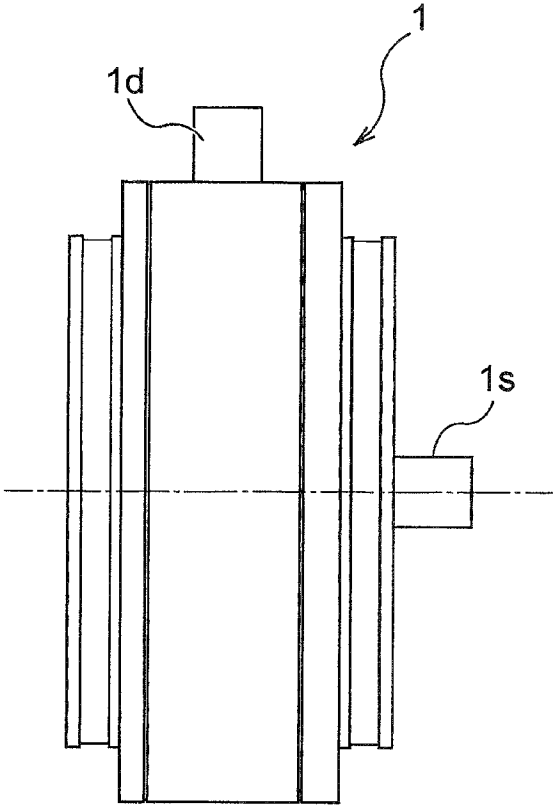

FIGS. 7A and 7B are views showing external appearance of the magnetic levitated centrifugal pump 1 shown in FIGS. 1 and 2. FIG. 7A is a front elevational view of the magnetic levitated centrifugal pump 1, and FIG. 7B is a side view of the magnetic levitated centrifugal pump 1.

As shown in FIGS. 7A and 7B, the magnetic levitated centrifugal pump 1 has a short circular cylindrical shape having both end surfaces and a circumferential surface, and has the suction port 1*s* formed on its one end surface and the discharge port 1*d* formed on its circumferential surface. As shown in FIGS. 7A and 7B, the magnetic levitated centrifugal pump 1 has an extremely simple structure.

Although the preferred embodiments of the present invention have been described above, it should be understood that the present invention is not limited to the above embodiments, but various changes and modifications may be made to the embodiments without departing from the scope of the appended claims.

What is claimed is:

1. A magnetic levitated pump comprising:

a pump casing having a suction port at a central part of the pump casing and a discharge port at an outer circumferential part of the pump casing;

an impeller housed in the pump casing and configured to be magnetically levitated, the impeller having a suction port at an axial end portion of the impeller and a projecting portion arranged on an opposite side of the suction port of the impeller and projecting from a rear surface of the impeller;

a permanent magnet motor configured to rotate the impeller, the permanent magnet motor being arranged on the opposite side of the suction port of the pump casing and the suction port of the impeller, wherein the arrangement of the suction port of the impeller and the suction port of the pump casing imparts a first axial force during operation, wherein the first axial force forces the impeller in a direction away from the permanent magnet motor, and wherein the permanent magnet motor imparts a second axial force acting on the impeller during operation, and the second axial force forces the impeller in an opposite direction to the first axial force to force the impeller in a direction toward the permanent magnet motor;

a non-permanent electromagnet configured to magnetically support the impeller, wherein the non-permanent electromagnet is separate from the permanent magnet motor, and the non-permanent electromagnet and the permanent magnet motor are positioned on opposite sides of the impeller such that they are arranged so as to face each other across the impeller, wherein the non-permanent electromagnet is separately controlled from the permanent magnet motor, and the non-permanent magnet imparts a third axial force upon the impeller which balances differences in forces upon the impeller resulting from differences between the first axial force and the second axial force; and a permanent magnetic radial repulsive bearing comprising first ring-shaped permanent magnets provided on the projecting portion projecting from the rear surface of the impeller and second ring-shaped permanent magnets provided on the pump casing so as to face the first ring-shaped permanent magnets in a radial direction of the impeller.

2. The magnetic levitated pump according to claim 1, wherein the permanent magnet motor includes a motor core and a motor coil facing toward the impeller on a first side of the impeller, and wherein the non-permanent electromagnet includes an electromagnet core and an electromagnet coil facing toward the impeller on a second side of the impeller.

3. The magnetic levitated pump according to claim 1, wherein the first ring-shaped permanent magnets on the impeller side are offset from the second ring-shaped permanent magnets on the pump casing side in the axial direction.

4. The magnetic levitated pump according to claim 1, wherein a sliding bearing is provided between an axial end portion of the impeller and a portion, of the pump casing, which radially faces the axial end portion of the impeller.

5. The magnetic levitated pump according to claim 1, wherein the displacement of the impeller is detected based on impedance of the electromagnet.

6. The magnetic levitated pump according to claim 1, wherein a liquid contact portion that is brought into contact with a liquid to be pumped in the pump casing comprises a resin material.

7. The magnetic levitated pump according to claim 1, wherein the first ring-shaped permanent magnets on the impeller side and the second ring-shaped permanent magnets on the pump casing side comprise a combination of permanent magnets which are magnetized in the axial direction and permanent magnets which are magnetized in the radial direction.

8. The magnetic levitated pump according to claim 2, further comprising:

an impeller permanent magnet positioned on the first side of the impeller and facing toward the motor core and motor coil of the permanent magnet motor; and a rotor magnetic pole positioned on the second side of the impeller and facing toward the electromagnet core and electromagnet coil.

9. The magnetic levitated pump according to claim 8, wherein:

the electromagnet core and electromagnet coil are mounted on the pump casing in a region of the pump casing through which a passage of the suction port extends such that the electromagnet core and the electromagnet coil surround the passage of the suction port; and the motor core and motor coil are mounted in a cover of the pump casing.

10. The magnetic levitated pump of claim 1, further comprising:

an impeller permanent magnet positioned on a first side of the impeller and facing the permanent magnet motor;

a rotor magnetic pole positioned on a second side of the impeller and facing the non-permanent electromagnet, wherein the second side of the impeller is an opposite side of the impeller with respect to the first side; and wherein the impeller permanent magnet and the rotor magnetic pole are positioned at a same radial position of the impeller but on opposite sides of the impeller.

11. The magnetic levitated pump of claim 10, wherein the non-permanent electromagnet is further configured to exert forces on the impeller to control forces in $\theta_x$ and $\theta_y$ directions, wherein the $\theta_x$ direction is a direction about a horizontal axis X, and the $\theta_y$ direction is about a vertical axis Y, with the non-permanent electromagnet comprising:

at least three pole pairs positioned at different circumferential positions of the non-permanent electromagnet, and wherein forces are controlled in the $\theta_x$ and $\theta_y$ directions by differentially energizing at least two pole pairs of the at least three pole pairs.

12. The magnetic levitated pump of claim 11, wherein the at least three pole pairs include first, second and third pole pairs, wherein the force in the $\theta_x$ direction is imparted upon the impeller by differentially energizing the first pole pair with respect to the second and third pole pairs, and wherein the force in the $\theta_y$ direction is generated by differentially energizing the second pole pair with respect to the third pole pair.

13. The magnetic levitated pump of claim 11, wherein the non-permanent electromagnet comprises four pole pairs.

14. The magnetic levitated pump of claim 13, wherein the four pole pairs include first, second, third and fourth pole pairs, and wherein the force in the $\theta_y$ direction is imparted upon the impeller by differentially energizing the first and second pole pairs with respect to the third and fourth pole pairs, and wherein the force in the $\theta_x$ direction is imparted upon the impeller by differentially energizing the first and fourth pole pairs with respect to the second and third pole pairs.

15. The magnetic levitated pump of claim 10, wherein the non-permanent electromagnet controls position of the impeller based on impedance of the non-permanent electromagnet without a position sensor of the impeller.

* * * * *